US007959095B2

(12) United States Patent
Brantley et al.

(10) Patent No.: US 7,959,095 B2
(45) Date of Patent: Jun. 14, 2011

(54) CENTER-FEED NOZZLE IN A CONTAINED CYLINDRICAL FEED-INLET TUBE FOR IMPROVED FLUID-ENERGY MILL GRINDING EFFICIENCY

(75) Inventors: Eric Lee Brantley, Wilmington, DE (US); Alan Roger Eaton, Hendersonville, TN (US); Stephen Claude De La Veaux, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 571 days.

(21) Appl. No.: 11/823,445

(22) Filed: Jun. 27, 2007

(65) Prior Publication Data

US 2009/0001201 A1 Jan. 1, 2009

(51) Int. Cl.
*B02C 19/06* (2006.01)

(52) U.S. Cl. ..... 241/5; 241/39

(58) Field of Classification Search ..... 241/5, 39, 241/40; 406/46–49, 93–94, 151–153, 194–195
See application file for complete search history.

(56) References Cited

U.S. PATENT DOCUMENTS

| | | | | |
|---|---|---|---|---|
| 1,901,797 | A * | 3/1933 | Black | 417/197 |
| 2,695,265 | A | 11/1954 | Degnen | |
| 2,821,346 | A | 1/1958 | Fisher | |
| 3,186,769 | A | 6/1965 | Howlett, Jr. | |
| 4,186,772 | A | 2/1980 | Handleman | |
| 4,860,959 | A * | 8/1989 | Handleman | 241/39 |
| 5,423,490 | A | 6/1995 | Zampini | |
| 5,577,670 | A | 11/1996 | Omata et al. | |
| 5,683,039 | A | 11/1997 | Leute et al. | |
| 5,732,893 | A | 3/1998 | Nied | |
| 6,402,068 | B1 | 6/2002 | Handleman | |
| 6,588,686 | B2 | 7/2003 | Dingee, IV et al. | |
| 6,951,312 | B2 | 10/2005 | Casalmir et al. | |
| 2006/0175441 | A1 | 8/2006 | Capelle, Jr. | |

* cited by examiner

*Primary Examiner* — Faye Francis

(57) ABSTRACT

This invention relates to a supersonic center-feed nozzle system within the feed-inlet tube of a fluid-energy mill used for grinding particulate material such as titanium dioxide. Particularly, in the feed-inlet tube of the present invention, particulate material is introduced into the supersonic feed jet of primary grinding fluid in almost a perpendicular fashion, with the supersonic nozzle installed in the center of the particulate material core, imparting momentum to the particulate material. The momentum entrains the particulate into the main grinding chamber of the feed-inlet tube. In the main grinding chamber of the feed-inlet tube, a secondary stream of grinding fluid, introduced annularly, constricts the primary jet's divergent flow, enabling a higher turbulent mixing of the grinding fluids and the particulate material.

6 Claims, 1 Drawing Sheet

CENTER-FEED NOZZLE IN A CONTAINED CYLINDRICAL FEED-INLET TUBE FOR IMPROVED FLUID-ENERGY MILL GRINDING EFFICIENCY

FIELD OF THE INVENTION

This invention relates to a supersonic center-feed nozzle system within the feed-inlet tube of a fluid-energy mill used for grinding particulate material such as titanium dioxide. Embodiments of the present invention achieve high efficiency grinding in that the particulate product quality is improved even at a lower energy consumption than with a standard design. Particularly, the present invention employs a primary jet and a secondary jet at supersonic velocity of the grinding fluid that enhances turbulence and interaction between the particulate material and the grinding fluids.

BACKGROUND OF THE INVENTION

Fluid-energy mills are used to reduce the particle size of a variety of materials such as pigments, agricultural chemicals, carbon black, ceramics, minerals and metals, pharmaceuticals, cosmetics, precious metals, propellants, resins, toner and titanium dioxide. The particle size reduction typically occurs as a result of particle-to-particle collisions and particle collision with the walls.

The fluid-energy mill typically comprises a hollow interior, the grinding chamber, where particle collisions resulting in grinding, occur. Within the grinding chamber, a vortex is formed via the introduction of a compressed gas or grinding fluid through fluid nozzles into the fluid-energy mill, wherein the fluid nozzles are positioned in an annular configuration around the periphery of the grinding chamber. The compressed grinding fluid (e.g., air, steam, nitrogen, etc.), when introduced into the grinding chamber, forms a high-speed vortex as it travels within the grinding chamber. The gas circles within the grinding chamber at a decreased radii until released from the grinding chamber through a gas outlet. The particles to be ground are deposited within the grinding chamber and swept up into the high-speed vortex, thereby resulting in high speed particle-to-particle collisions as well as collisions with the interior portion of the grinding chamber walls.

Particulate material and grinding fluid are introduced into the fluid-energy mill through a feed-inlet tube, which contains a feed nozzle for introduction of grinding fluid.

Typical nozzles that have been used include De Laval nozzles (converging-diverging nozzles) through which the grinding fluid (also known as compression gas) is injected into the grinding chamber. The particulate material is introduced into the feed-inlet tube from a chute. Particulate material distribution into the grinding fluid (for example, steam) can be irregular and results in unused grinding energy. In fact, the particulate material is found primarily concentrated along the feed-inlet tube wall such that the flow pattern is a core of grinding fluid surrounded by particulate material with limited mixing of the two. Particulate material introduced at low velocity from the feed chute is not likely to substantially penetrate the supersonic grinding fluid flow in this type of configuration. Consequently, the grinding occurs at the boundary between the particles and the high-velocity grinding fluid, also referred to as the shear zone. Thus, a sizeable portion of the kinetic energy of the grinding fluid is not utilized for grinding. As a result, a greater amount of energy is necessary and a greater volume of compression gas is required to grind the particulate material to the desired particle size. Energy efficiency would clearly improve if the available kinetic energy is more fully utilized through turbulent mixing of the particulate material and the grinding fluid.

In addition, turbulence is relatively less near the walls than in the core of the flow profile. Thus, larger agglomerates of particulate material are likely to pass through the feed-inlet tube into the grinding chamber of the fluid-energy mill without being ground to appropriate size.

Even a slight improvement in nozzle design would result in more effective use of energy in particle grinding and a significant reduction in steam consumption, thereby lowering variable production cost.

Thus, there is a need within the industry for a mechanism for reducing energy and grinding fluid consumption by increasing the mixing between the grinding fluid and the particulate material. The present invention addresses that problem in that particulate material is highly likely to get exposed to a high shear, high turbulence, region prior to entering the main body of the fluid-energy mill. For example, finished titanium dioxide pigment product for various uses, such as textiles, cosmetic additives, etc., requires a median particle size of ~0.4 micrometer. Before grinding, the median particle size of the pigment particles and agglomerates is generally on the order of about 1 micrometer. Most of this grinding occurs in a relatively small section of the feed-inlet tube. It is well-acknowledged that particle comminution is both energy intensive and remarkably inefficient, with as little as 5% of input energy actually translated into particle size reduction. Given the tremendous inefficiencies in the particle size reduction process, a new supersonic feed jet nozzle design that more efficiently grinds titanium dioxide particles in the fluid-energy mill feed-inlet tube is desirable.

The present invention overcomes these problems in that it proposes placing an annular jet downstream of the primary jet in the feed-inlet tube for introducing a secondary grinding fluid that enables additional contact between the particulate material and the grinding fluids in a turbulent zone.

SUMMARY OF THE INVENTION

This invention relates to a center-feed nozzle system for entraining and delivering particulate material into a grinding chamber of a fluid-energy mill, said center-feed nozzle system comprising:

(a) an L-shaped feed-inlet tube having a first end and a second end, said L-shaped feed-inlet tube comprising a first tube and a second tube that form said "L", said first tube comprising a proximal end and a distal end, said second tube comprising a proximal end and a distal end, said first tube and said second tube comprising a first wall having an inner face and an outer face, said first tube comprising said first end of said L-shaped tube at first tube's proximal position, and said second tube comprising said second end of said L-shaped tube at said second tube's proximal position, wherein said L-shaped tube defines a hollow interior with said distal end of said first tube and said distal end of said second tube forming the bend of said L-shaped feed-inlet tube;

(b) said L-shaped feed-inlet tube further comprising a primary jet nozzle for introduction of first grinding fluid, wherein said primary jet nozzle is mounted at the distal end of said first tube in a direction parallel to the central axis of said second tube, wherein the shape of said primary jet nozzle is such that the flow of said first grinding fluid emanating from said primary jet nozzle into said L-shaped tube is in a divergent flow profile; and (c) said second tube of said L-shaped tube further comprising an annular inlet for introduction of a second grinding fluid, wherein said annular inlet is proximate to said proximal end of said second tube, and wherein said annular inlet is at an angle of from about 90° to about 165° to the flow direction of said first grinding fluid.

This invention further relates to a method for reducing the size of particulate material, comprising:

(a) supplying particulate material as feed to a center-feed nozzle system, wherein said center-feed nozzle system is used for entraining and delivering said particulate material into a grinding chamber of a fluid-energy mill, said center-feed nozzle system comprising:

(i) an L-shaped feed-inlet tube having a first end and a second end, said L-shaped feed-inlet tube comprising a first tube and a second tube that form said "L", said first tube comprising a proximal end and a distal end, said second tube comprising a proximal end and a distal end, said first tube and said second tube comprising a first wall having an inner face and an outer face, said first tube comprising said first end of said L-shaped tube at first tube's proximal position, and said second tube comprising said second end of said L-shaped tube at said second tube's proximal position, wherein said L-shaped tube defines a hollow interior with said distal end of said first tube and said distal end of said second tube forming the bend of said L-shaped feed-inlet tube;

(ii) said L-shaped feed-inlet tube further comprising a primary jet nozzle for introduction of first grinding fluid, wherein said primary jet nozzle is mounted at the distal end of said first tube in a direction parallel to the central axis of said second tube, wherein the shape of said primary jet nozzle is such that the flow of said first grinding fluid emanating from said primary jet nozzle into said L-shaped tube is in a divergent flow profile; and (iii) said second tube of said L-shaped tube further comprising an annular inlet for introduction of a second grinding fluid, wherein said annular inlet is proximate to said proximal end of said second tube, and wherein said annular inlet is at an angle of from about 90° to about 165° to the flow direction of said first grinding fluid;

(b) supplying said first grinding fluid to said primary jet nozzle, wherein said primary jet nozzle is placed under the entrained particulate material entering said proximal end of said first tube of said L-shaped feed-inlet tube, wherein said first grinding fluid entrains said particulate material toward the downstream end of said second tube and into said second grinding zone;

(c) supplying said second grinding fluid, which enters said annular inlet impinging at an angle of from about 90° to 165° in an annular fashion on to said divergent flow profile of said first grinding fluid and entrained particulate material;

(d) introducing said particulate material and said grinding fluids exiting said distal end of said second tube, into said fluid-energy mill.

In one embodiment, the velocity of the first and/or the second grinding fluid is in the range of from about 0.5 Mach to about 7 Mach. In another embodiment, the particulate material to be ground is titanium dioxide.

BRIEF DESCRIPTION OF THE DRAWING

Many aspects of the embodiments of the present invention can be more fully understood with reference to the following drawing. The components set forth in the drawing are not necessarily to scale.

DETAILED DESCRIPTION OF THE INVENTION

Figure 1:
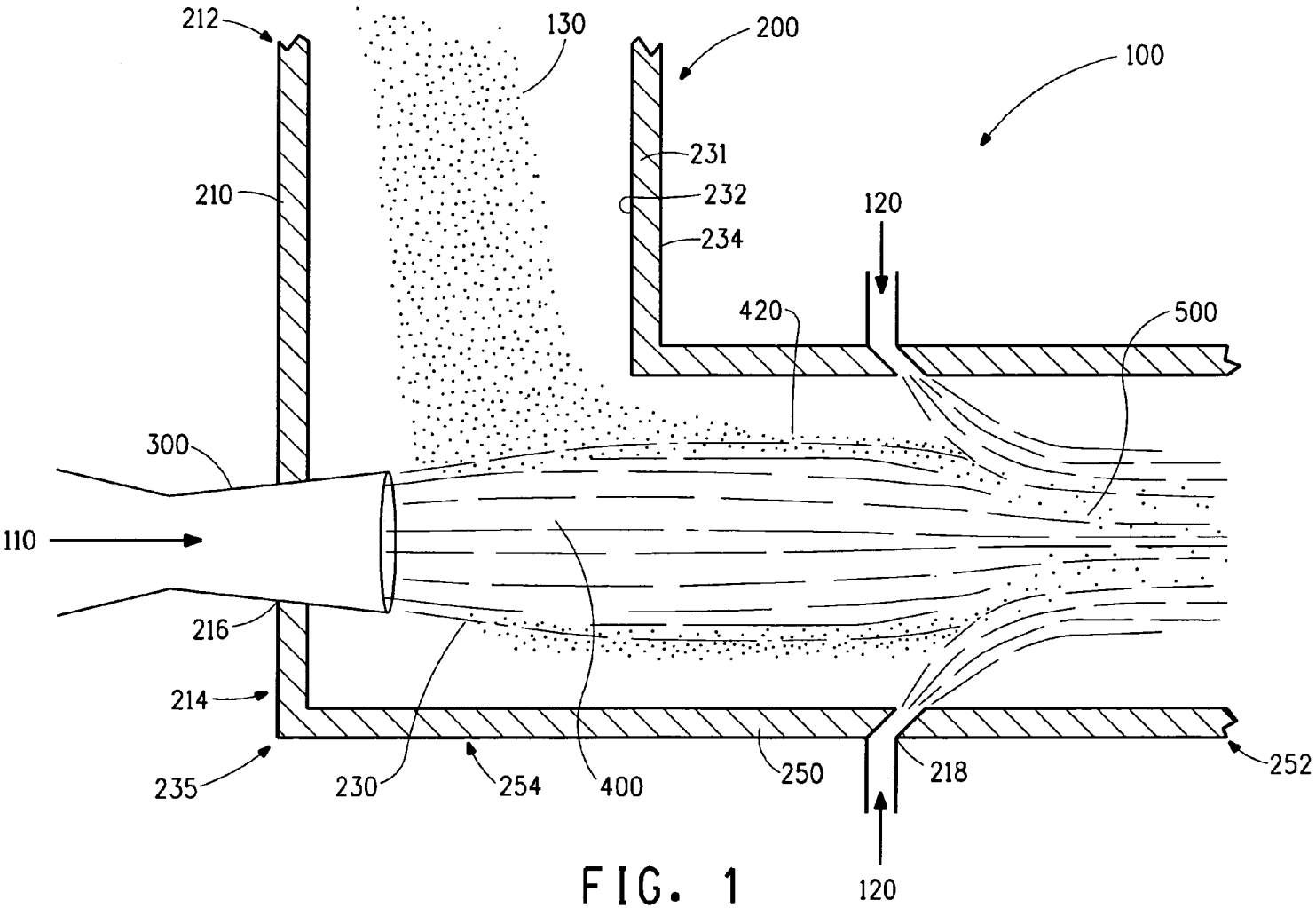
FIG. 1 shows a general schematic of a center-feed nozzle with two grinding zones.

Unless otherwise defined, all technical and scientific terms used herein have the same meaning as commonly understood by one of ordinary skill in the art to which this invention belongs. In case of conflict, the present specification, including definitions, will control.

Although methods and materials similar or equivalent to those described herein can be used in the practice or testing of the present invention, suitable methods and materials are described herein.

When an amount, concentration, or other value or parameter is given as either a range, preferred range or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

When the term "about" is used in describing a value or an end-point of a range, the disclosure should be understood to include the specific value or end-point referred to.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive 'or' and not to an exclusive 'or.' For example, a condition A or B is satisfied by any one of the following: A is true (or present) and B is false (or not present), A is false (or not present) and B is true (or present), and both A and B are true (or present).

Use of "a" or "an" are employed to describe elements and components of the invention. This is done merely for convenience and to give a general sense of the invention. This description should be read to include one or at least one, and the singular also includes the plural unless it is obvious that it is meant otherwise.

The materials, methods, and examples herein are illustrative only and, except as specifically stated, are not intended to be limiting.

By "grinding" of particulate material is meant a possible "size reduction" of particulate material. The term "grinding" and the term "size reduction" may be used interchangeably in this application. Both the terms are equivalent in their meaning.

By an "L-shape" as used herein, for example, in the feed-inlet tube context, is meant that the angle between the two "legs" of said "L-shape" is from about 75° to about 135°.

Generally, the present invention relates to a center-feed nozzle system used for grinding particulate material prior to further comminution of such particulate material in a fluid-energy mill. The center-feed nozzle system can be used in conjunction with any type of fluid-energy mill known in the art. The center-feed nozzle system, through a high-velocity feed jet flow, introduces the particulate material with the grinding fluid into the chamber of the fluid-energy mill through a feed-inlet tube. Particulate material as feed is introduced into the feed-inlet tube generally in a direction from about 0° to about 135° to the direction of the grinding fluid emanating from a primary jet nozzle. A second grinding fluid is introduced in an annular fashion, downstream from the primary jet nozzle. The second grinding fluid further adds energy to grinding of the particulate material and helps increase interaction between the high velocity grinding fluids and the particulate material.

The center-feed nozzle system creates two distinct grinding zones for the particulate material. For example, in one embodiment, the primary jet nozzle, a de Laval converging-diverging nozzle imparts momentum to, and partially grinds the particulate feed stream into, the first grinding zone. However, the particulate material is unable to effectively penetrate the jet steam core emanating from the de Laval nozzle. Downstream to the de Laval nozzle, and enclosed within the feed-inlet tube, is the second grinding zone. The first grinding fluid from the primary jet nozzle conveys the particulate material into the second grinding zone. The second grinding zone provides a higher turbulence region ensuring greater contact between the particulate material and the grinding fluids. The second grinding zone is created by a second grinding fluid, for example steam, injected in an annular fashion into the feed-inlet tube downstream from the primary jet nozzle. Injection of high pressure grinding fluid constricts flow from the primary jet into an even smaller volume, forcing a grinding fluid-particulate material interaction. The second grinding fluid also provides additional grinding energy to the particulate material stream such that particles that have escaped the primary jet nozzle are likely to be ground here. Thus, the particulate material is exposed to two high-velocity and high-turbulence grinding zones before entering the fluid-energy mill.

The primary jet nozzle of the center-feed nozzle can be a standard de Laval nozzle or an axisymmetric nozzle as described in U.S. patent application Ser. No. 11/315,571 (assigned to E. I. du Pont de Nemours and Co.).

The entire grinding jet system, including the de Laval primary jet and the annular jet, is enclosed within and physically constrained by the walls of the feed-inlet tube. The enclosure in such fashion promotes higher interaction between particulate material and the grinding fluid to maximize grinding on a unit energy basis. Particularly, energy losses due to expansion of grinding fluid are much less with this configuration than in a more open-ended design. Second, the two distinct grinding zones further minimize the possibility that a given particle escapes the primary jet unground. Third, the primary jet imparts momentum to the particulate material and forces it into the more intense grinding region created by the annular jet. Because the particulate material has already gained momentum when it is in the second grinding zone, less energy in the annular injection region is expended in providing momentum to particulate material. Thus, more energy is available for grinding.

The embodiments of the present invention may be utilized in the particle-size reduction of a wide variety of particulate material. Non-limiting examples of suitable types of particulate material include pigments, agricultural chemicals, carbon black, ceramics, minerals and metals, pharmaceuticals, cosmetics, precious metals, propellants, resins, toner and titanium dioxide. Grinding combinations of a variety of particulate material may also be performed. Typically, the particulate material is entrained in a grinding fluid feed stream, which may be compressed air or other gas or a combination of gases. Titanium dioxide is a preferred particulate material.

In one embodiment, this invention relates to a center-feed nozzle system for entraining and delivering particulate material into a grinding chamber of a fluid-energy mill, said center-feed nozzle system comprising:

(a) an L-shaped feed-inlet tube having a first end and a second end, said L-shaped feed-inlet tube comprising a first tube and a second tube that form said "L", said first tube comprising a proximal end and a distal end, said second tube comprising a proximal end and a distal end, said first tube and said second tube comprising a first wall having an inner face and an outer face, said first tube comprising said first end of said L-shaped tube at first tube's proximal position, and said second tube comprising said second end of said L-shaped tube at said second tube's proximal position,
   wherein said L-shaped tube defines a hollow interior with said distal end of said first tube and said distal end of said second tube forming the bend of said L-shaped feed-inlet tube;

(b) said L-shaped feed-inlet tube further comprising a primary jet nozzle for introduction of first grinding fluid, wherein said primary jet nozzle is mounted at the distal end of said first tube in a direction parallel to the central axis of said second tube,
   wherein the shape of said primary jet nozzle is such that the flow of said first grinding fluid emanating from said primary jet nozzle into said L-shaped tube is in a divergent flow profile; and (c) said second tube of said L-shaped tube further comprising an annular inlet for introduction of a second grinding fluid, wherein said annular inlet is proximate to said proximal end of said second tube, and
   wherein said annular inlet is at an angle of from about 90° to about 165° to the flow direction of said first grinding fluid.

FIG. 1 shows a schematic of the center-feed nozzle system (100) of the present invention. The operation of the center-feed nozzle system (100) and the fluid-energy mill (not shown) includes the use of a first grinding fluid (110) and a second grinding fluid (120). The first grinding fluid (110) or the second grinding fluid (120) may comprise a single fluid or a combination of fluids thereby forming a composite fluid stream. The combinations of fluids and the proportions of each fluid therein may be varied to meet the necessary parameters for the particular grinding application.

Non-limiting examples of grinding fluids include air, nitrogen, steam and combinations thereof, wherein steam is preferred. Composite fluid streams may comprise steam and a second gas or other combination of gases.

Typically, depending upon the grinding fluid to be used, the first or the second grinding fluid is delivered at a particular temperature and pressure. Such parameters are known to those skilled in the art. For example, steam is often heated to a temperature ranging from about 220° C. to about 340° C., preferably ranging from about 260° C. to about 305° C. prior to delivery into the center-feed nozzle (100). Preferably, it is supplied at a pressure of about 375 psi (2.580 MPa) to about 500 psi (3.450 MPa), more preferably ranging from about 390 psi (2.688 MPa) to about 440 psi (3.032 MPa). From calculations, it can be shown that at the above-described parameters, the grinding fluid having a velocity (when measured at the point of discharge from the center-feed nozzle) of up to about Mach 6.8 (A speed of Mach 1 corresponds to the speed of sound, which is about 340 m/s. A speed of Mach 6.8 is 6.8 times the speed of sound, i.e., about 2312 m/s). It should be noted that Mach number relates to the velocity of sound in a medium and sound moves faster in steam than in air.

Generally, the ratio of the first grinding fluid to the second grinding fluid is in the range of from about 5:95 to about 95:5. Preferably the range is from about 10:90 to about 90:10.

As shown in FIG. 1, particulate material (130) is supplied to the center-feed nozzle (100) through an L-shaped feed-inlet tube (200). The L-shaped feed-inlet tube (200) comprises of two hollow tubes, the first tube (210) and the second tube (250). The first tube (210) comprises of a proximal end (212) and a distal end (214). The second tube (250) comprises of a proximal end (252) and a distal end (254). The distal end (214) of the first tube (210) and the distal end (254) of the second tube (250) form the bend (235) in the L-shaped feed-inlet tube (200).

At the distal end (214) of the first tube (210), is an inlet (216) for the primary nozzle jet (300). The primary nozzle jet can be a de Laval type of a nozzle or an axisymmetric nozzle. Generally, but not necessarily, the primary jet (300) provides the first grinding fluid (110) into the feed-inlet tube (200) in such manner that the flow profile of the high-velocity first grinding fluid (110) as it progresses into the second tube (250) of the feed-inlet tube (200) is divergent (230).

The first grinding fluid (110) forms the first grinding zone (400) where the first grinding fluid (110) and the particulate material (130) first interact. The divergent flow of the first grinding fluid (110) moves forward in the second tube (250) as it entrains the particulate material (130) in a translational direction, generally parallel to the second tube (250).

Downstream, along the second tube (250), is an annular inlet (218), through which the second grinding fluid (120) is supplied under high velocity and high compression. The direction of the second grinding fluid (120) to that of the general direction of the first grinding fluid (110) is in the range of from about 90° to about 165°. The angle is measured between the general direction of the flow of first grinding fluid (110) and the direction opposite of the general direction flow of the second grinding fluid (120) emanating from the annular jet (218). Preferably, the range is from about 135° to 165°. The second grinding fluid direction can be desirably obtained by changing the orientation of the annular inlet (218) relative to the second tube (250). The second grinding fluid (120) impinges on the divergent flow stream (420) of the first grinding fluid (110) and the entrained particulate material (130) and constricts the divergent flow stream as shown in FIG. 1. This is the second grinding zone (500) wherein the high velocity second grinding fluid helps enhance the interaction between the grinding fluids (110, 120) and the particulate material (130). The second grinding region (500) is of high turbulence. The grinding fluids (110, 120) and the comminuted particulate material (130) are then introduced into a fluid-energy mill (not shown) for further size reduction.

Process of Particulate Size Reduction

As shown in FIG. 1, the embodiments of the present invention further contemplate a method of reducing the size of particulate material (130). In one embodiment, the method comprises the following steps:

(a) supplying particulate material (130) as feed to a center-feed nozzle system (100), wherein said center-feed nozzle system (100) is used for entraining and delivering said particulate material (130) into a grinding chamber of a fluid-energy mill (not shown), said center-feed nozzle system (100) comprising:

(i) an L-shaped feed-inlet tube (200) having a first end (212) and a second end (252), said L-shaped feed-inlet tube (200) comprising a first tube (210) and a second tube (250) that form said "L", said fst tube (210) comprising a proximal end (212) and a distal end (214) and said second tube (250) comprising a proximal end (252) and a distal end (254), said first tube (210) and said second tube (250) comprising a wall (231) having an inner face (232) and an outer face (234), said first tube (210) comprising said first end (212) of said L-shaped feed-inlet tube (200) at said first tube's (210) proximal position, and said second tube comprising said second end (252) of said L-shaped tube (200) at said second tube's (250) proximal position, wherein said L-shaped tube (200) defines a hollow interior with said distal end of said first tube (210) and said distal end of said second tube (250) forming the bend (235) of said L-shaped feed-inlet tube (200);

(ii) said L-shaped feed-inlet tube (200) further comprising a primary jet nozzle (300) for introduction of first grinding fluid (110), wherein said primary jet nozzle (300) is mounted at the distal end of said first tube (210) in a direction parallel to the central axis of said second tube (250), wherein the shape of said primary jet nozzle (300) is such that the flow of said first grinding fluid (110) emanating from said primary jet nozzle (300) into said L-shaped tube (200) is in a divergent flow profile (230); and (iii) said second tube (250) of said L-shaped tube (200) further comprising an annular inlet (218) for introduction of a second grinding fluid (120), wherein said annular inlet (218) is proximate to said proximal end of said second tube (250), and wherein said annular inlet (218) is at an angle of from about 90° to about 165° to the flow direction of said first grinding fluid (110).

(b) supplying said first grinding fluid (110) to said primary jet nozzle (300), wherein said primary jet nozzle (300) is placed under the entrained particulate material (130) entering said proximal end (212) of said first tube (210) of said L-shaped feed-inlet tube (200), wherein said first grinding fluid (110) entrains said particulate material (130) toward the downstream end of said second tube (250) and into said second grinding zone (500);

(c) supplying said second grinding fluid (120), which enters said annular inlet (218) impinging at an angle of from about 90° to 165° in an annular fashion on to said divergent flow profile (420) of said first grinding fluid (110) and entrained particulate material (130);

(d) introducing said particulate material (130) and said grinding fluids (110, 120) exiting said distal end (254) of said second tube (250), into said fluid-energy mill (not shown).

What is claimed is:

1. A center feed nozzle system comprising:

a) a L-shaped feed inlet comprising a first and a second end; a wall surrounding a hollow interior comprising a central axis, b) the wall comprising i) an exterior surface, ii) an interior surface, iii) an annular inlet consisting of a hollow interior beginning on the exterior surface and extending at an angle from about 90° to about 165° through the wall to the interior surface forming one annular opening; and iv) a jet nozzle;

wherein the jet nozzle and the annular inlet are positioned on the wall so that the jet nozzle produces a flow to the central axis and the annular inlet is located downstream of the flow.

2. A process for reducing the size of particulate comprising:

1) supplying particulate material to a center-feed nozzle system, wherein the center-feed nozzle system comprises:

a) a L-shaped feed inlet comprising a first and a second end; a wall surrounding a hollow interior comprising a central axis, b) the wall comprising i) an exterior surface, ii) an interior surface, iii) an annular inlet consisting of a hollow interior beginning on the exterior surface and extending at an angle from about 90° to about 165° through the wall to the interior surface forming one annular opening, and iv) a jet nozzle;

wherein the jet nozzle and the annular inlet are positioned on the wall so that the jet nozzle produces a flow to the central axis and the annular inlet is located downstream of the flow;

2) supplying a first grinding fluid to the jet nozzle;

3) supplying a second grinding fluid to the annular inlet 4) supplying the particulate material, the first grinding fluid, and the second grinding fluid from the center feed nozzle system into a grinding chamber of a fluid energy mill.

3. The process of claim 2, wherein the first and the second grinding fluids flow at a velocity of from about 0.5 Mach to about 7 Mach.

4. The process of claim 2, wherein the particulate material comprises titanium dioxide.

5. The process of claim 2, wherein the first and the second grinding fluids each comprise a gaseous fluid selected from the group consisting of air, nitrogen, steam and a combination thereof.

6. The process of claim 2, wherein the first and/or the second grinding fluid(s) comprises steam.

* * * * *